US008904841B2

(12) United States Patent
Buchegger

(10) Patent No.: US 8,904,841 B2
(45) Date of Patent: Dec. 9, 2014

(54) ROLLER DRIVE AND A ROLLER STAND WITH SUCH A DRIVE

(75) Inventor: Rudolf Buchegger, Sankt Florian (AT)

(73) Assignee: Voith Patent GmbH, Heidenheim (DE)

( * ) Notice: Subject to any disclaimer, the term of this patent is extended or adjusted under 35 U.S.C. 154(b) by 884 days.

(21) Appl. No.: 12/734,689

(22) PCT Filed: Dec. 10, 2009

(86) PCT No.: PCT/EP2009/008818
§ 371 (c)(1),
(2), (4) Date: Apr. 5, 2011

(87) PCT Pub. No.: WO2011/000397
PCT Pub. Date: Jan. 6, 2011

(65) Prior Publication Data

US 2011/0174043 A1 Jul. 21, 2011

(30) Foreign Application Priority Data

Jun. 30, 2009 (DE) ..... 10 2009 031 324

(51) Int. Cl.
*B21B 31/07* (2006.01)
*B21B 35/14* (2006.01)

(52) U.S. Cl.
CPC ..... *B21B 35/141* (2013.01); *B21B 35/148* (2013.01); *B21B 35/142* (2013.01)
USPC ..... 72/249

(58) Field of Classification Search
CPC ..... B21B 31/02; B21B 31/07; B21B 35/00; B21B 35/14; B21B 35/142; B21B 35/143
USPC ..... 72/238, 239, 245, 247, 249; 464/155, 464/156, 157, 158, 159
See application file for complete search history.

(56) References Cited

U.S. PATENT DOCUMENTS

| | | | | |
|---|---|---|---|---|
| 3,020,735 | A * | 2/1962 | Wegmann | 464/113 |
| 6,062,058 | A * | 5/2000 | Buchegger | 72/249 |
| 6,991,546 | B2 * | 1/2006 | Rucker | 464/169 |
| 7,784,380 | B2 * | 8/2010 | Berger et al. | 74/825 |

FOREIGN PATENT DOCUMENTS

| | | | |
|---|---|---|---|
| CN | 101277771 | A | 10/2008 |
| DE | 1206836 | B | 12/1965 |
| DE | 1602160 | A1 | 6/1970 |
| DE | 2454036 | A1 | 5/1976 |
| EP | 0822872 | B2 | 8/2005 |
| JP | S 50-37661 | | 4/1975 |
| JP | S 51-71253 | | 6/1976 |
| JP | 60037205 | A | 2/1985 |
| JP | S 60-37205 | | 2/1985 |
| JP | 61193711 | A | 8/1986 |
| JP | S 61-193711 | | 8/1986 |
| JP | S 63-53305 | | 4/1988 |
| JP | S 63-91729 | | 6/1988 |
| JP | H 2-138006 | | 11/1990 |
| JP | H 3-18910 | | 2/1991 |
| JP | H 5-245517 | | 9/1993 |
| JP | H 11-503975 | | 4/1999 |
| JP | 2000-61516 | | 2/2000 |
| JP | 2001-300612 | | 10/2001 |

OTHER PUBLICATIONS

CN Office Action dated May 30, 2013.
English Translation of Japanese Office Action dated Apr. 28, 2014 for Japanese Patent Application No. 2012-516519.

* cited by examiner

*Primary Examiner* — Edward Tolan
(74) *Attorney, Agent, or Firm* — Farjami & Farjami LLP

(57) ABSTRACT

The invention relates to a roller drive, comprising a first drive train for transmitting drive power from a first drive motor to a first roller;

a second drive train for transmitting drive power from the same or a second drive motor to a second roller;

the two drive trains each comprise a universal shaft, comprising a first joint permitting a larger angular deviation and a second joint permitting a larger angular deviation;

an end part of each universal shaft which is remote from the roller is associated with one of the drive motors or the common drive motor, and is driven by the same;

an end part of each universal shaft which is close to the roller is associated with one of the rollers in order to drive the same;

the two end parts of each universal shaft are connected with each other via the two joints and a middle part connected to both joints.

The roller drive in accordance with, the invention is characterized by the following features:

the two end parts which are close to the roller are each connected to a toothed coupling with length compensation which is intended for coaxial or substantially coaxial connection to a drive pin of one of the rollers, with the toothed coupling having two coupling halves which are displaceable in the longitudinal direction and are in drive connection with each other via a meshing engagement;

each universal shaft and each toothed coupling are supported via a common radial bearing which is positioned directly on or adjacent to the joint between the middle part and the end part of the universal shaft which is close to the roller.

20 Claims, 2 Drawing Sheets a
b
1
2
3
4
5
6
6.1
6.2
6.3
7
8
9
11
12
13
14
15
17
19
20
21
22

ROLLER DRIVE AND A ROLLER STAND WITH SUCH A DRIVE

This is a U.S. national phase application which is based on, and claims priority from PCT application Serial No. PCT/EP2009/008818, filed on Dec. 10, 2009, which claims priority from foreign application Serial No. DE 102009031324.9, filed on Jun. 30, 2009 in Germany.

The invention relates to a roller drive according to the preamble of claim 1 and a roller stand according to the preamble of claim 15.

Roller drives with a universal shaft of the illustrated kind in each drive train have long been known to the person skilled in the art. For example, JP-60-37205 describes a roller stand with an upper and a bottom, roller which each have an independent drive in the form of a drive motor. A toothed coupling is arranged at first in each drive train, starting with the respective roll pin, followed by a connecting shaft in the direction of the drive motor which is held in a radial bearing, followed by a universal joint shaft, before the drive motor is connected directly or indirectly via a further connecting shaft at the end of the universal joint shaft which is remote from the roller. The radial bearing of the connecting shaft between the toothed coupling and the universal joint shaft is arranged in such a way that the connecting shaft is held at two points in a generally centered manner by means of a relatively large and axially long bearing. Although this bearing has a common outer support part, two radial rolling bearings are provided per connecting shaft.

A rolling mill with a roller drive according to the preamble of claim 1 has been disclosed in the patent application published for opposition DT 24 54 036 B2. Each roller drive comprises a universal shaft, which is designated here as articulated spindles, which is connected via a coupling (not shown in closer detail) with the roller and on the other side, which is remote from the roller, via a coupling with axial length compensation with the motor shaft. In order to enable a different axial distance of the drive motors, an intermediate shaft and a further coupling that allows longitudinal displacements are provided in the upper roller between the coupling with length compensation connected to the motor shaft and the end of the universal shaft which is remote from the roller. The middle parts of the articulated spindles are supported via two laterally arranged support beams, on which the articulated spindles are held in two bearing points each. The support beams are connected on the one side with hydraulic supports, whereas they are held on the other side in bearing blocks. The middle parts are therefore held in a balanced manner in the center with two bearings when considered together.

The European patent EP 0 822 872 B2 further describes a roller stand with two rollers which form a gap and which can be driven via drive shafts by separate drive motors. In this system, one drive train is each provided with one toothed coupling each in combination with a further articulated linkage, with the toothed coupling being disposed directly adjacent to the drive pin of the roller and enabling axial length compensation. The roller drive thus deviates considerably from the previously mentioned generic drive trains in that merely one single drive train per pair of rollers comprises an articulated linkage with two joints permitting a larger angular deviation, whereas the other drive shaft extends as an integral toothed spindle from the toothed coupling up to a coupling which is arranged on the drive shaft of the motor and permits angular shaft displacements, which coupling is preferably also a toothed coupling. Whereas the toothed couplings each permit an angular position in the range between 0.5 and 1.5 degrees, preferably an angular position of approx. 0.8 degrees, universal shafts as are provided in each drive train for each roller permit angular displacements clearly over this range, e.g. more than 5 degrees, 10 degrees or even 20 degrees.

The common aspect in all roller drives is that the bending forces which act upon the drive pins of a roller and on the elements in the drive train require a more or less strong dimensioning of individual components depending on the support by the radial bearing. When using universal shafts with two joints as in this case, which each permit a larger angular deviation, it is further necessary to take into account the cardan error, according to which increasingly higher forces act upon the connecting parts with increasing articulations. Furthermore, the use of comparatively massive universal shafts in order to transfer large torques leads to a large weight of the universal shafts, leading to comparatively large forces acting upon the connecting parts of the universal shaft.

The present invention is based on the object of providing a roller drive and a roller stand with such a roller drive in which an optimal distribution of the bending forces, weights and the forces from the cardan error despite a small number of radial bearings, and all components provided in the drive train can be provided with a relatively slender configuration.

The object in accordance with the invention is achieved by a roller drive with the features of claim 1. Claim 15 provides a roller stand in accordance with the invention. The dependent claims describe advantageous and especially appropriate developments of the invention.

The roller drive in accordance with the invention starts out from a plurality of drive trains, at least two drive trains, for transmitting drive power from one drive motor each to one roller each. It is alternatively also possible to have the two drive trains or the plurality of drive trains driven by one or several drive motors, or to provide several drive motors per drive train. In the case of a drive of the universal shafts by a common motor, the universal shafts can be driven via a so-called pinion stand gearbox which divides the engine torque simultaneously among the first and second universal shaft, especially among an upper and lower universal shaft.

One universal shaft is provided in each drive train, comprising a first joint permitting a larger angular deviation, and a second joint permitting a larger angular deviation. The joints therefore do not concern couplings or toothed couplings which permit only the small angular deviations according to the introduction of the description. Rather, angular deviations of more than 5 degrees, especially more than 10 degrees, between the two end parts of the universal shaft are possible, especially even between each end part and the middle part of the universal shaft.

An end section of each universal shaft which is remote from the roller is each associated with one of the drive motors or the common drive motor and is driven by the same. For this purpose, the end part remote from the roller can be connected directly to a drive shaft of the drive motor or by interposing one or several connecting shafts or the like.

An end part of each universal shaft which is remote from the roller is associated with one each of the rollers in order to drive the same.

As is common practice in universal shafts, the two end parts, i.e. the end part close to the roller and the end part remote from the roller, of each universal shaft are connected with each other via the two joints and a middle part connecting the two joints. The middle part is arranged especially without any length compensation, which means it advantageously has a fixed axial length. The two middle parts of the two universal shafts of the different drive trains can be arranged with a different axial length according to one embodiment. The joints per se can be arranged as a universal joint or also as another articulated coupling permitting a respective angular deviation, e.g. a flat pin coupling.

In accordance with the invention, the two end parts of each universal shaft which is close to the roller are each connected to a toothed coupling with length compensation, with the toothed coupling with length compensation being designated for coaxial or substantially coaxial connection to a drive pin of one of the rollers. The connection can be direct or indirect. A coupling half of the toothed coupling, e.g. in the form of a sleeve or a pin, is advantageous which is connected directly to the drive pin of the roller, e.g. by enclosing the drive pin in a torque-proof manner or by engaging in the drive pin in a drive connection.

The toothed coupling comprises two coupling halves in accordance with the invention, which coupling halves are displaceable in the longitudinal direction with respect to one another and are in meshing engagement with one another in a drive connection, with the meshing engagement being formed advantageously by a toothing pair, of which at least one toothing is arranged in a crowned manner in order to enable an especially easy sliding into each other and introduction into each other or to enable a comparatively low angular deviation between the two coupling halves, especially in the range of 0.4 degrees, or in the range of an angular deviation which was mentioned in the introduction to the description for a toothed coupling.

In order to achieve the optimal bearing of the roller drive concerning the introduced weights, bending forces and forces from the cardan error, each universal shaft and each toothed coupling is supported via one common radial bearing each which is positioned directly on or adjacent to the joint between the middle part and the end part of the universal shaft which is remote from the roller.

The middle part of each universal shaft is advantageously free from a radial bearing and/or free from any shaft bearing which is arranged remote from the joint between the middle part and the end part close to the roller. In particular, no bearing is provided in the region of the axial middle and/or at the end of the middle part of the universal shaft which is remote from the roller, or any bearing support at the two axial ends of the middle part which are combined to a common support of the middle part, as is common practice according to the state of the art.

According to an especially advantageous embodiment of the invention, the common radial bearing of the universal joint and the toothed coupling is arranged on the side of the middle part of the universal joint directly adjacent to the respective joint, so that it encloses the middle part of the universal joint. In this way it is possible to achieve an especially advantageous length division concerning the end part of the universal joint in combination with the toothed coupling and the middle part of the universal joint. The middle part can be arranged in a comparatively longer way, leading to smaller articulations in the universal shaft. The end part can be arranged in a shorter way together with the toothed coupling, leading to lower bending moments which are exerted by the drive train on the drive pin of the roller. It is a further advantage that as a result of the larger distance between the longitudinal axes of the middle part in comparison with the distance between the longitudinal axes of the toothed couplings of both rollers, especially an upper roller and a bottom roller which jointly form the roll gap, the radial bearing can be provided with a larger outside diameter, so that its outer ring can especially be arranged in a sturdier manner. It is also possible to position the bearing interface, i.e. the interface between the revolving and stationary part of the bearing in which especially the roller bodies in the form of cylindrical rollers for example are positioned, on a comparatively larger diameter, through which the possible power absorption is increased.

The radial bearing can advantageously be suspended in an articulated manner in order to compensate angular movements of the middle part.

A lifting mechanism for the radial bearing, especially jointly for the radial bearings of both universal shafts, can be arranged advantageously in such a way that it is synchronized with a movement of one of the two rollers forming the roll gap, specially the working roller in the axial direction for example, in order to ensure a small articulation at all times, especially a constant articulation, on the toothed couplings.

It is further possible to arrange the toothed couplings free from a separate radial bearing, so that the two coupling halves are carried only by the drive pin of the roller and the universal shaft or its end part close to the roller.

The two toothed couplings which are associated with a pair of rollers forming the roll gap can have different axial lengths relative to one another. In total, the two toothed couplings can be arranged in a comparatively short way although they enable axial length compensation. It is not necessary to provide an axial path in the toothed couplings for this length compensation which prevents a collision with the stationary radial bearing.

In order to prevent the toothed coupling from slipping off or out of the drive pin of the roller, a pressing apparatus can be provided which presses at least the roller-side coupling half or both coupling halves of the toothed coupling in the axial direction towards the roller or the drive pin. This pressing apparatus must not be confused with the radial bearing provided in accordance with the invention which is capable of absorbing considerable radial forces.

In an especially advantageous manner, the gearing of one of the two coupling halves in the meshed engagement extends over a multiple of the gearing of the other coupling half. For example, an inner gearing extends over a multiple in the direction of an outside gearing or vice-versa.

A roller stand in accordance with the invention comprises at least two rollers forming a roll gap, which rollers are driven by two drive motors via a roller drive which is arranged according to the roller drive in accordance with the invention. At least one roller of the pair of rollers can be displaced advantageously in the axial direction optionally relative to the other roller in order to vary the shape of the roll gap in cooperation with a respectively arranged roller surface, especially the axial end region of the roll gap. This is known to the person skilled in the art in rolling mills, especially for producing steel sheet or other sheets, and therefore need not be explained in further detail.

Further advantageous developments of the invention will be explained below by reference to an embodiment and the enclosed drawings by way of examples, wherein.

Figure 1:
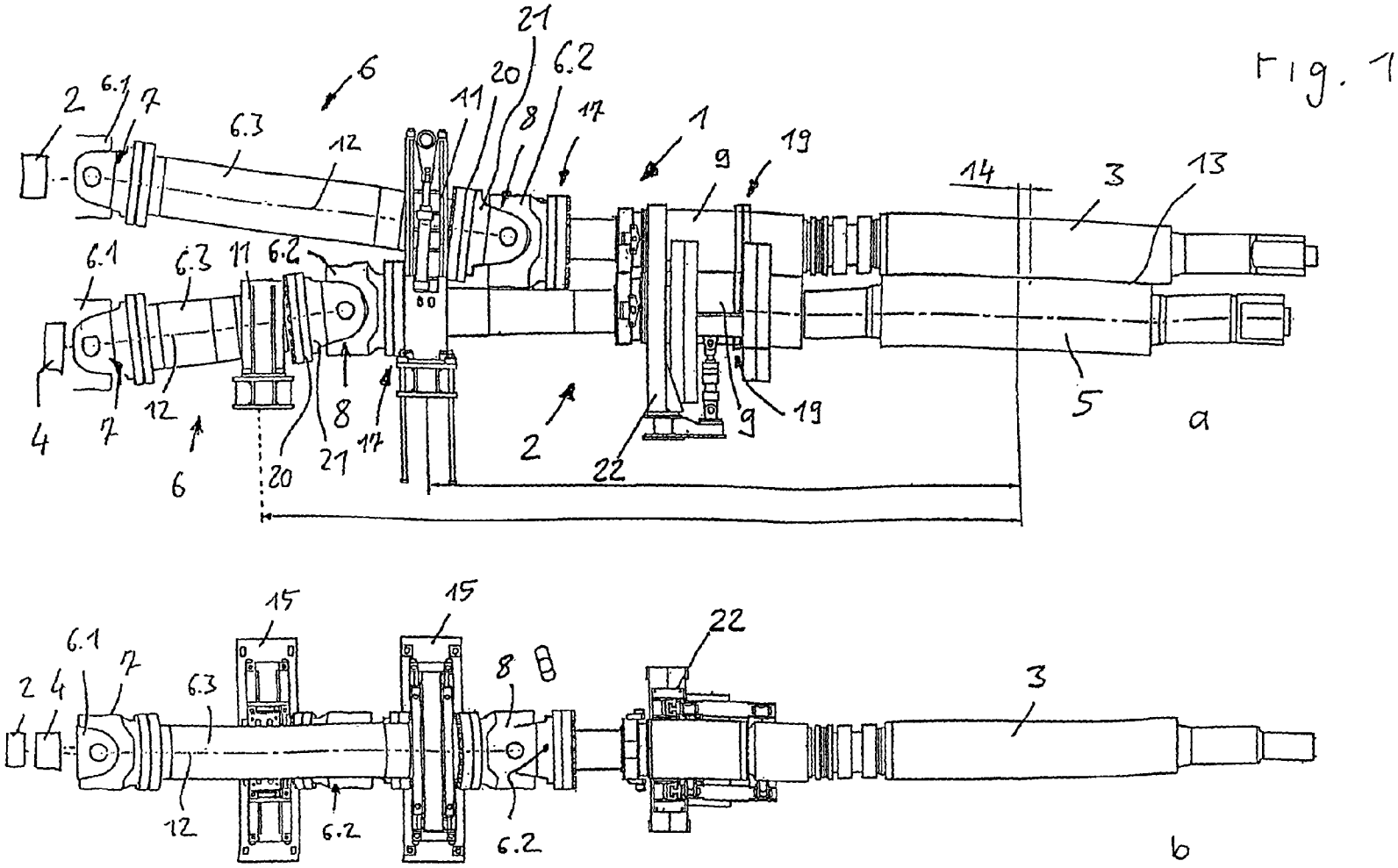
FIG. 1 shows a side view and a top view of a roller drive arranged in accordance with the invention or a roller drive arranged in accordance with the invention.

FIG. 1*a* shows a schematic side view and FIG. 1*b* a top view of a roller stand in accordance with the invention, and the roller drive of the roller stand with a first upper drive train 1 for transmitting drive power from a first drive motor 2 to a first roller 3 and a second bottom drive train 2 for transmitting drive power from a second drive motor 4 to a second roller 5. The first roller 3 and the second roller 5 jointly form a roll gap 13.

As is indicated by the double arrow 14, the first roller is displaceable in the axial direction relative to the second roller 5 and has a comparatively larger axial extension for this purpose.

Both drive trains 1, 2 each have a universal shaft 6, comprising a first joint 7 permitting a larger angular deviation and a second joint 8 permitting a larger angular deviation.

The end part 6.1 of each universal shaft 6 which is remote from the roller is associated to one each of the drive motors 2, 4 and is driven by the same. The end part 6.2 of each universal shaft 6 which is close to the roller is associated to one each of the rollers 3, 5 in order to drive the same with length compensation by interposing a toothed coupling 9. The first joint 8 of the universal shaft 6 which is remote from the roller and the second joint 8 of the universal shaft 6 which is close to the roller are connected with each other via a middle part 6.3 of the universal shaft 6, with the middle part 6.3 being composed of three sections in this case, which is a comparatively long middle section, on which one part each is flange-mounted with a joint yoke on both sides.

Each middle part 6.3 of the universal shaft is supported directly by a radial bearing 11 which is positioned adjacent to the second joint 8. As a result of the flanges provided at both ends of the middle part 6.3 or its middle section, bearing 11 is arranged as a bearing divided over the circumference, comprising two or more segments, especially circular ring segments which can be connected to each other in order to form a closed bearing ring.

The radial bearing 11 which additionally could also have an axial bearing function not only discharge weights and bending forces of the universal shaft 6 and forces from the cardan error of the universal shaft 6 to a bearing foundation 15, but also simultaneously carries the toothed coupling 9, so that the drive pin of each roller 3, 5 only needs to take up half the weight of the toothed coupling 9.

Reference numeral 22 indicates a pressing apparatus which is provided in order to press the toothed coupling 9 in the direction of the rollers 3, 5.

As can be seen in FIG. 1, the longitudinal axes 12 of the middle parts 6.3 of the universal shafts 6 diverge towards one another. It is further also possible that the coupling halves of the toothed coupling which are remote from the roller diverge, towards one another as a result of the angular deviation possibility in the toothed coupling 9, but not to the extent of the longitudinal axes 12 of the middle parts 6.3.

The radial bearing 11 which is associated with the first drive train 1 as is indicated by the dimensioning lines, has a shorter distance to the first roller 3 than the radial bearing 11 which is associated with the second drive train 2.

Figure 2:
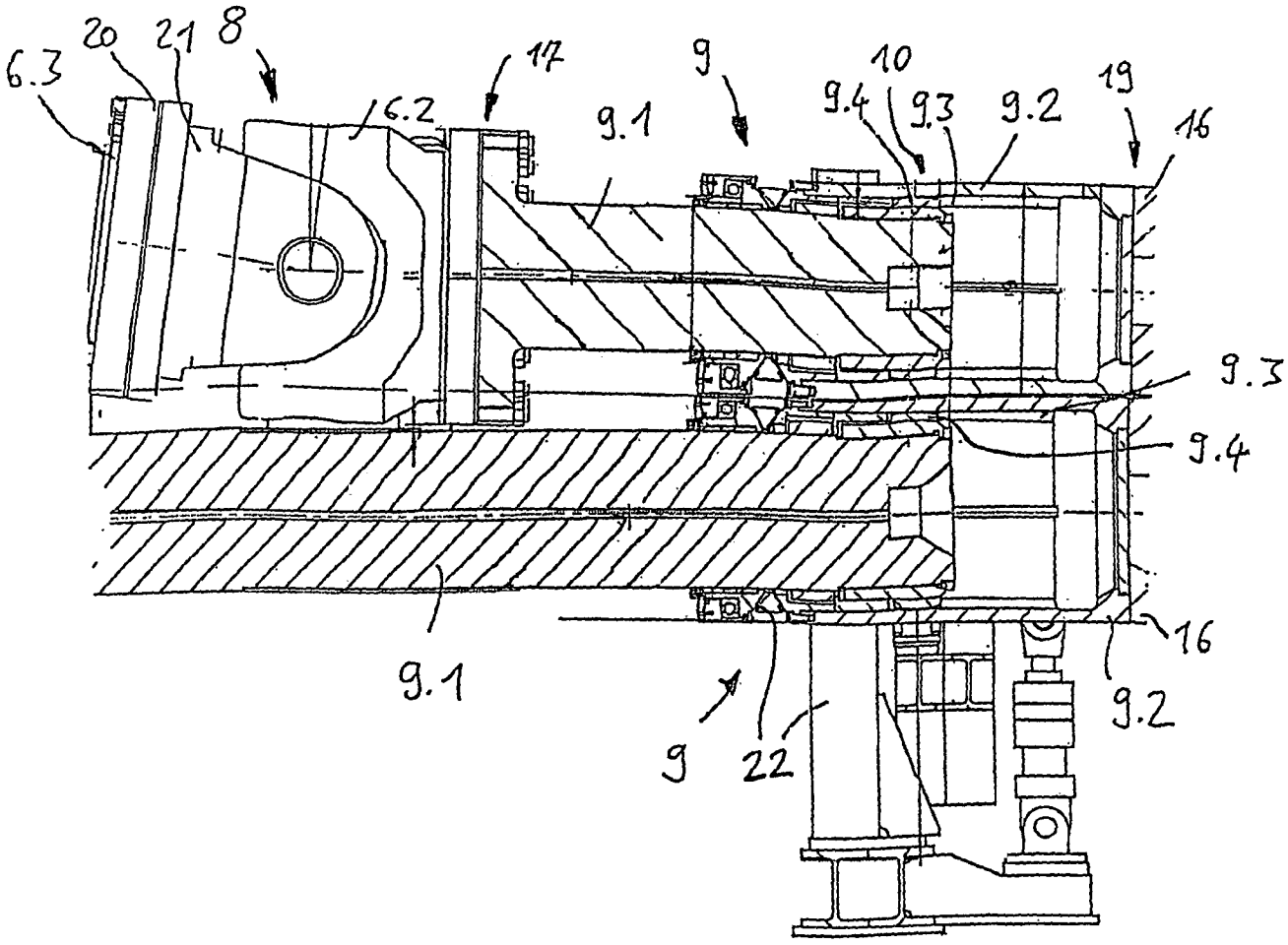
FIG. 2 shows a schematic sectional view through the roller drive according to FIG. 1 in the region of the meshing engagement of the toothed couplings.

FIG. 2 now shows further details of the toothed coupling 9 in a schematic view.

The right side in FIG. 2 shows the end region of a sleeve 16 which is remote from the roller and is slid onto a drive pin (not shown) of the respective roller in a drive connection. The second coupling half 9.2 which is close to the roller is disposed in the axial direction away from the roller (not shown in FIG. 2), which coupling half has an internal gearing 9.3. The internal gearing 9.3 is in meshing engagement with an external gearing 9.4 of the first coupling half 9.1 of the toothed coupling 9 which is remote from the roller. The external gearing 9.4 of the first coupling half 9.1 has a crowned shape, as is shown, which means an arching which extends in the axial direction in the toothed coupling 9.

The first coupling half 9.1 is connected via a flange connection 17 with the end part 6.2 of the universal shaft 6. This flange connection 17 is also shown in FIG. 1. A second flange connection 19 is further indicated, both in FIG. 1 and FIG. 2, with which the second coupling half 9.2 is connected to the sleeve 16 which encloses the roller pin.

The axial length compensation in the toothed coupling 9 is achieved in the present case by the meshing engagement 10, which in FIG. 2 occurs with the internal gearing 9.4 and the external gearing 9.3. It is understood that it is also possible to provide further measures for length compensation.

As is shown especially in FIG. 1, the radial bearings 11 each enclose a middle part 6.3 of the universal shaft 6 and are positioned directly adjacent to the joint 8. In the present case, the positioning is chosen directly adjacent to the flange connection 20 which connects the half 21 of the second joint 8 which is remote from the roller, to which one could also refer as the joint yoke that is remote from the roller, with the integral middle section of the middle part 6.3 which is cylindrical in this case and which, as mentioned, has a respective flange connection at its end which is remote from the roller. That is why a closer positioning of the radial bearing 11 in the direction of the rotational axis of the second joint 8 is not possible or only with difficulty. In any case, the positioning of the radial bearing 11 deviates from a bearing in the region of the middle of the middle part 6.3 which balances the middle part 6.3, or via two supporting points in the region of two ends of the middle part 6.3.

The radial bearing 11 advantageously does not reach up to the axial middle of the universal shaft 6 or the middle part 6.3 of the universal 6, respectively. The radial bearing 11 is arranged in an especially advantageous way in the outer third or in the outer quarter of the axial extension of the universal shaft 6 or the middle part 6.3 of the universal shaft 6.

The invention claimed is:

1. A roller drive comprising:

a first drive train for transmitting drive power from a first drive motor to a first roller;

a second drive train for transmitting drive power from the first drive motor to a second roller or a second drive motor to the second roller;

the first drive train and the second drive train each comprises a universal shaft, each universal shaft comprising a first joint permitting a larger angular deviation and a second joint permitting a larger angular deviation;

a first end part of each universal shaft being remote from the first and/or second rollers is associated with a common drive motor or at least one of the first drive motor and the second drive motor, wherein the first end part of each universal shaft is driven by the common drive motor or at least one of the first drive motor and the second drive motor;

a second end part of each universal shaft being close to the first and/or second rollers is associated with at least one of the first roller and the second roller in order to drive the at least one of the first roller and the second roller;

the first end part and the second end part of each universal shaft are connected via the first joint and the second joint and a middle part connected to the first joint and the second joint;

wherein the second end part of each universal shaft are each connected to a toothed coupling with length compensation that is intended for coaxial or substantially coaxial connection to a drive pin of at least one of the first roller and the second roller;

wherein the toothed coupling has two coupling halves that are displaceable in a longitudinal direction and are in drive connection with each other via a meshing engagement;

wherein the universal shaft and the toothed coupling of the first drive train are supported via a first common radial bearing that is positioned directly on or adjacent to the second joint between the middle part and the second end part of the universal shaft, and the universal shaft and the toothed coupling of the second drive train are supported via a second common radial bearing that is positioned directly on or adjacent to the second joint between the middle part and the second end part of the universal joint close to the roller.

2. The roller drive according to claim 1, wherein the middle part of each universal shaft is free from at least one of a radial bearing and any shaft bearing which is positioned remote from the second joint between the middle part and the second end part.

3. The roller drive according to claim 1, wherein the first common radial bearing encloses the middle part of the universal shaft associated with the first drive train and the second common radial bearing encloses the middle part of the universal shaft associated with the second drive train.

4. The roller drive according to claim 3, wherein the toothed coupling is free from at least one of the first common radial bearing and the second common radial bearing and is carried only by the universal shaft and thus by at least one of the first common radial bearing and the second common radial bearing which encloses the middle part of the universal shaft and the drive pin of the roller.

5. The roller drive according to claim 1, wherein at least one of the first joint and the second joint is a universal joint or a flat-pin coupling.

6. The roller drive according to claim 1, wherein the first joint and the second joint are offset in relation to one another in the axial direction.

7. The roller drive according to claim 1, wherein the middle parts of the universal shafts have different axial lengths in relation to one another.

8. The roller drive according to claim 1, wherein the toothed couplings have different axial lengths in relation to one another.

9. The roller drive according to claim 1, wherein the teeth of at least one coupling half of the meshing engagement between the coupling halves have a crowned shape.

10. The roller drive according to claim 1, wherein a pressing apparatus is provided in a region of the toothed couplings, the pressing apparatus presses at least the coupling half of the toothed coupling that is close to the roller in the axial direction in the direction of the roller.

11. The roller drive according to claim 1, wherein distances in the axial direction are different between the two common radial bearings and the rollers in relation to one another.

12. The roller drive according to claim 1, wherein longitudinal axes of the middle parts of the universal shafts diverge towards one another.

13. The roller drive according to claim 1, wherein longitudinal axes of the two coupling halves of the toothed coupling which are remote from the roller diverge towards one another.

14. The roller drive according to claim 1, wherein gearing of at least one of the two coupling halves extends in a direction of a longitudinal axis of the toothed coupling over a multiple of the gearing of the other coupling half.

15. A roller stand with at least two rollers that form a roller gap and are driven by a common drive motor or two drive motors via a roller drive, the roller drive comprising;

a first drive train for transmitting drive power from a first drive motor to a first roller;

a second drive train for transmitting drive power from the first drive motor to a second roller or a second drive motor to the second roller;

the first drive train and the second drive train each comprises a universal shaft, each universal shaft including a first joint permitting a larger angular deviation and a second joint permitting a larger angular deviation;

a first end part of each universal shaft that is remote from the first and/or second rollers is associated with a common drive motor or at least one of the first drive motor and the second drive motor, wherein the first end part of each universal shaft is driven by the common drive motor or at least one of the first drive motor and the second drive motor;

a second end part of each universal shaft that is close to the first and/or second rollers is associated with at least one of the first roller and the second roller in order to drive the at least one of the first roller and the second roller;

the first end part and the second end part of each universal shaft are connected via the first joint and the second joint and a middle part connected to the first joint and the second joint;

wherein the second end part of each universal shaft are each connected to a toothed coupling with length compensation that is intended for coaxial or substantially coaxial connection to a drive pin of at least one of the first roller and the second roller;

wherein the toothed coupling has two coupling halves that are displaceable in a longitudinal direction and are in drive connection with each other via a meshing engagement;

wherein the universal shaft and the toothed coupling of the first drive train are supported via a first common radial bearing that is positioned directly on or adjacent to the second joint between the middle part and the second end part of the universal shaft, and the universal shaft and the toothed coupling of the second drive train are supported via a second common radial bearing that is positioned directly on or adjacent to the second joint between the middle part and the second end part of the universal joint close to the roller.

16. The roller stand according to claim 15, wherein the middle part of each universal shaft is free from at least one of a radial bearing and any shaft bearing which is positioned remote from the second joint between the middle part and the second end part.

17. The roller stand according to claim 15, wherein the first common radial bearing encloses the middle part of the universal shaft associated with the first drive train and the second common radial bearing encloses the middle part of the universal shaft associated with the second drive train.

18. The roller stand according to claim 17, wherein the toothed coupling is free from at least one of the first common radial bearing and the second common radial bearing and is carried only by the universal shaft and thus by at least one of the first common radial bearing and the second common radial bearing which encloses the middle part of the universal shaft and the drive pin of the roller.

19. The roller stand according to claim 15, wherein at least one of the first joint and the second joint is a universal joint or a flat-pin coupling.

20. The roller stand according to claim 15, wherein the first joint and the second joint are offset in relation to one another in the axial direction.

* * * * *